US005507526A

United States Patent [19]

Petkovsek

[11] Patent Number: 5,507,526

[45] Date of Patent: Apr. 16, 1996

[54] SINGLE LAYER MULTI-PART MAILER ASSEMBLY

[75] Inventor: Glenn Petkovsek, 20 Tortoise Park Cove, Little Rock, Ark. 72211-2349

[73] Assignee: Glenn Petkovsek, Little Rock, Ark.

[21] Appl. No.: 343,237

[22] Filed: Nov. 22, 1994

Related U.S. Application Data

[62] Division of Ser. No. 147,553, Nov. 5, 1993, which is a division of Ser. No. 913,893, Jul. 16, 1993, Pat. No. 5,316, 208.

[51] Int. Cl.[6] ..... B42D 15/00

[52] U.S. Cl. ..... 283/62; 285/116

[58] Field of Search ..... 283/116, 117, 283/67; 462/64, 65; 229/69

[56] References Cited

U.S. PATENT DOCUMENTS

| | | | |
|---|---|---|---|
| D. 342,955 | 1/1994 | Bankier et al. . | |
| 605,929 | 6/1898 | Smead . | |
| 2,887,327 | 5/1959 | Tucker | 283/116 |
| 3,608,736 | 9/1971 | Wong . | |
| 3,682,321 | 8/1972 | Smith . | |
| 3,701,434 | 10/1972 | Moore . | |
| 4,160,803 | 7/1979 | Potts . | |
| 4,287,065 | 9/1981 | Raines . | |
| 4,418,865 | 12/1983 | Bowen . | |
| 4,502,713 | 3/1985 | Conti | 283/116 |
| 4,520,958 | 6/1985 | Jones et al. | 283/116 X |
| 4,565,317 | 1/1986 | Kranz . | |
| 4,600,507 | 7/1986 | Shimizu et al. . | |
| 4,682,793 | 7/1987 | Walz . | |
| 4,769,145 | 9/1988 | Nakajima . | |
| 4,787,971 | 11/1988 | Donald . | |
| 4,849,061 | 7/1989 | Relyea . | |
| 4,874,691 | 10/1989 | Chandler . | |
| 4,902,481 | 2/1990 | Clark et al. . | |
| 5,043,082 | 8/1991 | Hermann, Jr. et al. . | |
| 5,156,811 | 10/1992 | White . | |
| 5,190,210 | 3/1993 | Walz . | |
| 5,294,041 | 3/1994 | Whiteside | 283/116 X |
| 5,376,048 | 12/1994 | Whiteside | 283/116 X |

*Primary Examiner*—Willmon Fridie, Jr.
*Attorney, Agent, or Firm*—Hill, Steadman & Simpson

[57] ABSTRACT

A multi-part mailing assembly includes a single-layer form of detachable parts related to each other. The assembly is combined with an envelope that both exposes and secures the parts and other contents for specialized mail handling. Spaced horizontal and vertical tear lines separate the form into multiple related parts. In addition, opposite marginal edges are also perforated for continuous pin or sprocket feeding of the stock through printing equipment. Additional vertical tear lines remove the margins after printing, and transverse tear lines separate the forms from each other. The envelope secures the parts after being detached from each other into position within compartments of the envelope along with other inserted materials. Open or transparent areas allow printed information on the appropriate portion of the related part to be seen from the outside of the envelope after it is sealed for mailing. One or more of the printed parts may be removed from its place inside the sealed envelope without disturbing or exposing the balance of the inserted contents.

7 Claims, 9 Drawing Sheets

SINGLE LAYER MULTI-PART MAILER ASSEMBLY

This is a division of application Ser. No. 08/147,553, filed Nov. 5, 1993 which is a divisional of U.S. patent application Ser. No. 07/913,893, filed Jul. 16, 1993, now issued as U.S. Pat. No. 5,316,208.

BACKGROUND OF THE INVENTION

1. Field of the Invention

This invention relates to a multi-part mailer assembly. More particularly, this invention relates to a multi-part single-layer form suited for feeding through computer printers, in combination with an envelope which secures the parts in position for specialized postal processing and handling.

2. Description of the Related Art

A known procedure for specialized postal processing and handling has previously required printing or writing information on various separate slips of paper and attaching the slips by various means to the outside of an envelope. Such a procedure is commonly used in preparing certified, registered and/or insured mail.

For example, in using forms supplied by the United States Postal Service for certified mail, it is necessary to separately address and complete a certified mailing receipt. In addition, both faces of the return receipt card, the envelope to be mailed, and the request for return receipt service on the face of the envelope is required to be addressed. Separately affixing by glue, an adhesive, tape or other means is required to attach a certified mail slip and the return receipt card to the outside of the addressed envelope.

In U.S. Pat. No. 4,682,793 to Walz, a multiple-part mailer form assembly is shown in which the addressing of the multiple forms required for certified mail or other specialized postal handling may be accomplished by continuously-fed impact-type printers. The parts are then separated from each other for affixing some parts to the outside of a standard window envelope which can be addressed by the insertion of one of the extra form layers.

However, this type of multiple-layer continuous assembly cannot be addressed or overprinted in the non-impact printers that have recently come into common use, or on less-expensive impact-type printers which have no means to adjust for strength of impact or thickness of multiple-layer forms. Additionally, the address information printed on the intermediate or rear layers of such forms is often degraded or blurred to less readable condition by the necessity of printing through the above layers. This degradation renders unfeasible the use of a postal barcode on the lower layers of address inserts to be compatible with U.S. Postal Service sorting equipment that is now generally used. In addition, this degradation renders unfeasible the use of high-density barcodes in other formats for automated identification of the return receipt postal card when it is returned to the sender as proof of delivery to the addressee.

Furthermore, this prior mailer requires forms to be separately affixed to the outside of the envelope by using a glue, adhesive, tape, or other means. The prior type includes a significant amount of carrier, backing, carbon layer, peel-off or other materials that must be handled and removed during use and discarded as waste after use. The prior mailer requires chemical treatment of some layers of the form in manufacturing. Also, though the prior mailer is not suitable for feeding through automatic non-impact printers, the return address of the sender must be printed on the back of the return receipt card portion of the form by non-impact means, i.e. either hand-printing or labeling or offset printing during the manufacturing process, in order to avoid unwanted reverse printing of the return address on the face of the other layers. Finally, the prior multiple-part mailer provides no means to note the request for return receipt service, if desired, on the face of the envelope as required by postal regulations.

Clearly, the process of preparing certified, registered, and/or insured mail is tedious, complicated, and labor-intensive, particularly for businesses and institutions in which items such as notifications, reminders, or valuable documents are commonly sent by specialized mail services. In many instances, the delivery of such mail must be documented by recording a U.S. Postal Service return receipt when it arrives back to the sender, a task which is also time-consuming and has great potential for error when all the identifying information from each return receipt card must be recorded or entered by hand.

There has not previously been available a mailer assembly that solves these problems. More particularly, there has not previously been available a mailer assembly that solves these problems with the efficiency of manufacture, ease of use, and utility in practice of the present invention.

SUMMARY OF THE INVENTION

The present invention solves the above-mentioned problems by providing a single-layer multi-part mailer assembly in which all related parts of the form portion of the mailer are printed on one layer of material thereby simplifying production, explanatory instructions and use.

In addition, related parts of the form portion may be addressed or otherwise overprinted by a great variety of means. The forms may be selectively addressed either by an impact-type printer or by a non-impact printer or by a non-adjustable impact printer. Since all related parts are connected on the same sheet, they can be addressed or otherwise overprinted in a single pass or feed through automated printing equipment.

If desired, requests for return receipt service may be automatically printed such that it is visible on the face of the assembled mailer without additional writing, printing, or stamping of an envelope by a user. Therefore, a minimal amount of handling is required to separate and insert related parts as opposed to other known methods thereby making the assembly easy to use and efficient in operation.

In addition, materials are simple and inexpensive to produce on conventional printing and envelope folding equipment resulting in less paper, chemical, or other resources being used in manufacturing. Less material is, therefore, wasted or discarded in use.

A sheet form is divided by tear lines into parts that each serve a defined purpose in the process of preparing mail for specialized postal handling. For certified mail, for example, one detachable part preferably tears down to fit a main compartment of an envelope with designated areas for printing information required to be visible on the front of the mail piece in register with window areas of the envelope.

Other detachable parts of the form tear down to predetermined sizes set by postal regulations to serve specific purposes, such as a certified mail return receipt postcard-type form. Another detachable part may be in the form of the certified mail receipt to be retained by the sender as proof of mailing. Each of the detached parts bears the same identifying certified mail article number printed in a type and style for optical character recognition processing.

Additional tear lines allow other parts of the form to be torn down to serve as postcards for additional or follow-up mailings. Such areas may contain instructions for use or reply or may be retained by the sender or inserted for mailing to the addressee. Modified placement of the tear lines allows multiple copies of the same or sequential parts to be produced in the same sheet.

To allow the form to feed automatically through pin or sprocket-fed printers, forms may be provided in a continuous length separable from one other by transverse tear lines and separable from marginally-perforated side edges with suitable longitudinal tear lines. These tear lines are perforated so as to be weaker than the tear lines dividing the basic form into its parts. The application of a pulling or tearing force removes the complete forms from each other such that the margins separate from the complete form before the detachable parts of each form begin to separate from each other.

The envelope includes a front panel with window openings in register with the defined printing areas on the address insert part of the sheet form when detached and inserted. A back panel includes a window opening and tear lines to allow opening of the back panel. Side flaps or other separating material are adhesively connected to each other at the point where they overlap after folding thereby forming two compartments. When materials are placed inside both compartments, materials in the main compartment are visible through the windows on the front panel, and materials in the back compartment are visible through the window on the back panel.

BRIEF DESCRIPTION OF THE DRAWINGS

Other objects and advantages of this invention will become apparent from the following detailed description and accompanying drawings of embodiments of this invention. The drawings constitute a part of this specification and include exemplary embodiments of the present, invention and illustrate various objects and features thereof.

DETAILED DESCRIPTION OF THE PREFERRED EMBODIMENTS

It is to be understood that the present invention disclosed herein are merely exemplary embodiments of the invention which may be embodied in various forms. For illustration only, the embodiments presented are shown as the invention could be produced for the purpose of preparing certified mail. Therefore, specific structural and functional details disclosed herein are not to be interpreted as limiting, but merely a basis for the claims and as a representative basis for teaching one skilled in the art to variously employ the present invention in virtually any appropriately detailed construction.

Figure 1:
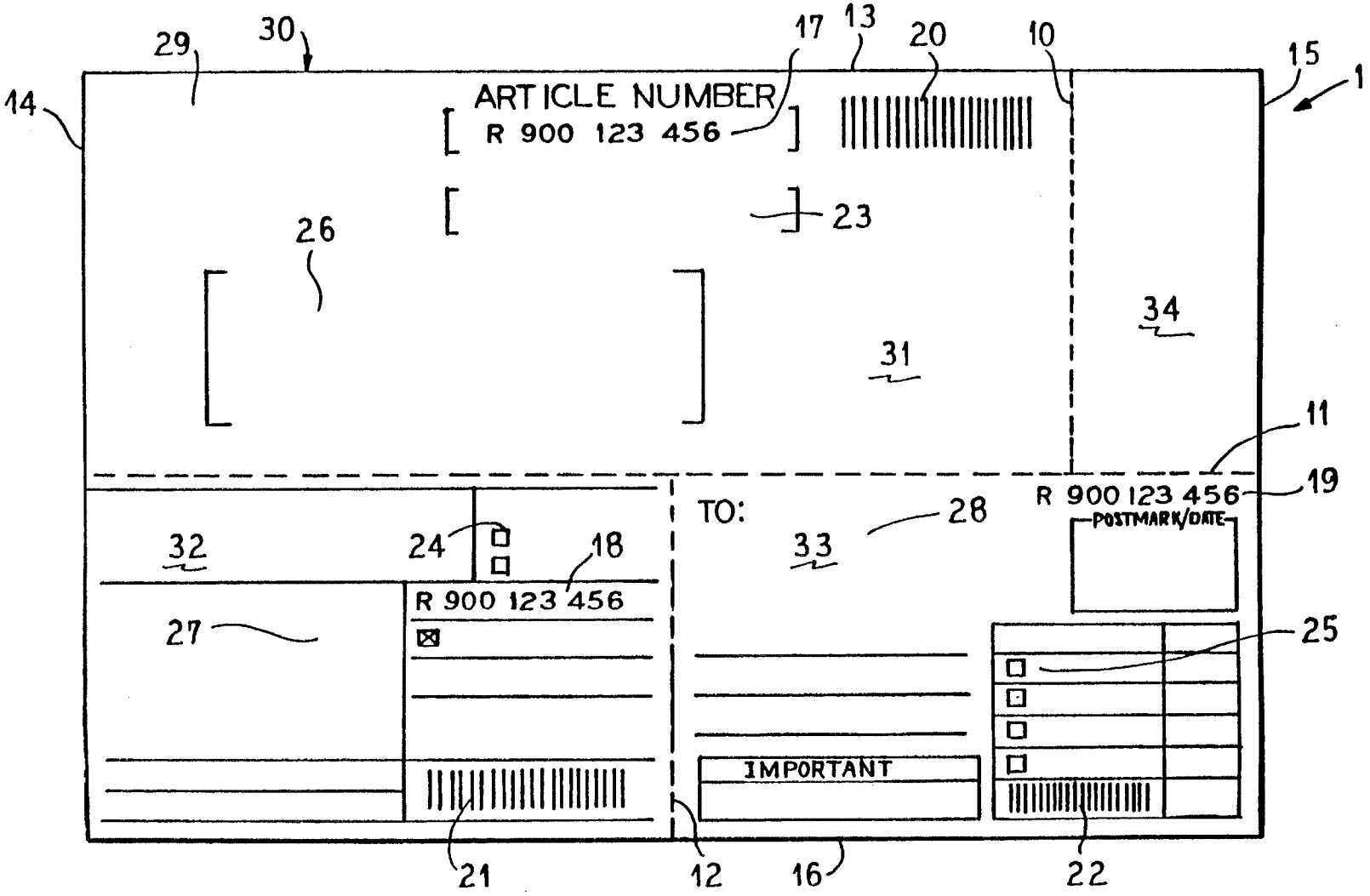
FIG. 1 is a plan, view of a single-sheet form according to a preferred embodiment of the form portion of the present invention.

As shown in FIG. 1, a sheet form 1 has a tear line 10 separating an insert part 31 of the form 1 from an instruction part 34. A second tear line 11 separates the insert part 31 and instruction part 34 of form 1 from a reply part 32 and a receipt part 33. A third tear line 12 separates the reply part 32 from the receipt part 33 of the form 1.

The form 1 is defined by a top edge 13, a left marginal edge 14, a right marginal edge 15 and a bottom edge 16. The insert part 31, reply part 32 and receipt part 33 each contain an identifying number area 17, 18 and 19, respectively. The number corresponds to an article number and is identical on each part 31, 32 and 33 such that the form 1 is consistently identified. In addition, the insert part 31, reply part 32 and receipt part 33 each include a barcode area 20, 21 and 22, respectively, which contain identical barcode information relating to the article number in the article number areas 17, 18 and 19.

Each part 31, 32 and 33 further contain a special services notation area 23, 24 and 25, respectively, for identifying specific instructions for a given mailing. Each part 31, 32 and 33 also includes an addressee address area 26, 27 and 28, respectively, for printing the address either manually or using a printer on the form 1. In addition, as shown in FIG. 1, the form 1 includes a front 29 and a back 30. Certain information, such as the sender's return address, or postal markings, or instructions to the addressee, may be printed or recorded on the back 30 as required for return receipt service.

For example, the front and back of each part, i.e. the insert part 31 having a front 31*a* and a back 31*b*, the reply part having a front 32*a* and a back 32*b*, and the same for the receipt part 33 and the instruction part 34 having a front and back 33*a*, 33*b* and 34*a*, 34*b*, respectively. The back 32*b* of the reply card 32 must include the sender's return address and postage information printed on it. The back of the other parts may have information printed as well, if desired.

Figure 2:
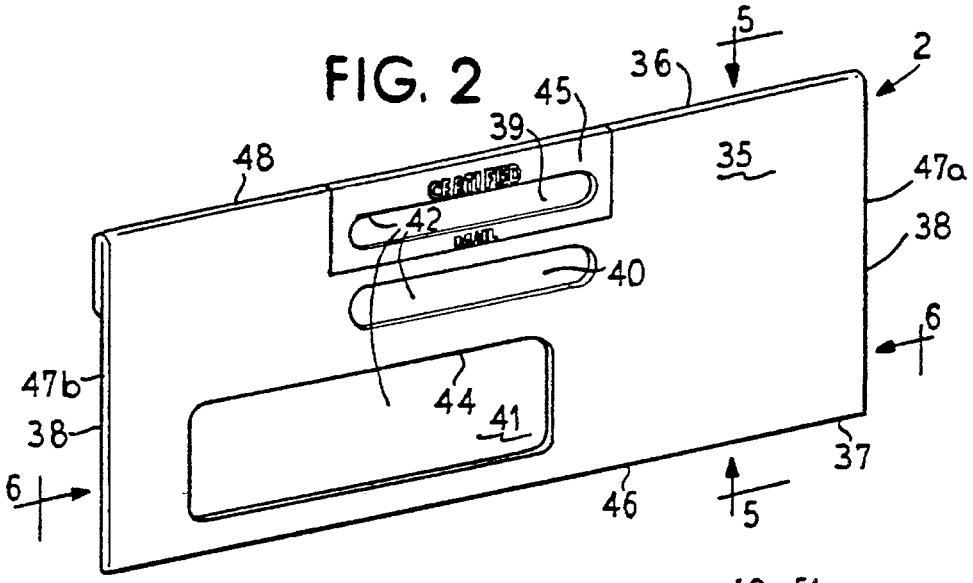
FIG. 2 is a front perspective view of an envelope according to a preferred embodiment of the envelope portion of the present invention.

FIG. 2 illustrates an envelope 2 as a whole. A front panel 35 of the envelope 2 includes an upper edge 36, a lower edge 37 and two side edges 38*a* and 38*b*. An upper window 39 on the front panel 35 of the envelope 2 is transparent to allow an article number from the article number area 17 of the form 1 to be read through the envelope 2.

A middle window 40 on the front panel 35 of the envelope 2 is located below the upper window 39 and allows the special services notation area 23 of the insert part 31 of the form 1 to be read through the envelope 2. A lower address window 41 on the front panel 35 allows the address area 26 of the form 1 to be read through the envelope 2. A transparent material 42 is adhesively attached to an inner surface 44 of the front panel 35 of the envelope 2. The material 42 may be made of a variety of transparent and lightweight materials as desired.

A printed area 45 surrounds the upper window 39 indicative of the type of special postal handling for the mail piece, such as, for example, "Certified Mail". A lower fold line 46 separates the front panel 35 from back panel 63 (shown in FIG. 3) at lower edge 37. Side flap fold lines 47*a* and 47*b* separate side flaps 55*a* and 55*b* (shown in FIG. 3) from the back panel 63 at the side edges 38*a* and 38*b*, respectively. Finally, a seal flap fold line 48 separates a seal flap 49 (shown in FIG. 3) from the front panel 35 at the upper edge 36 of the envelope 2. In all cases, fold lines may be replaced by glued joinings (sometimes referred to as a "welded seam").

Figure 3:
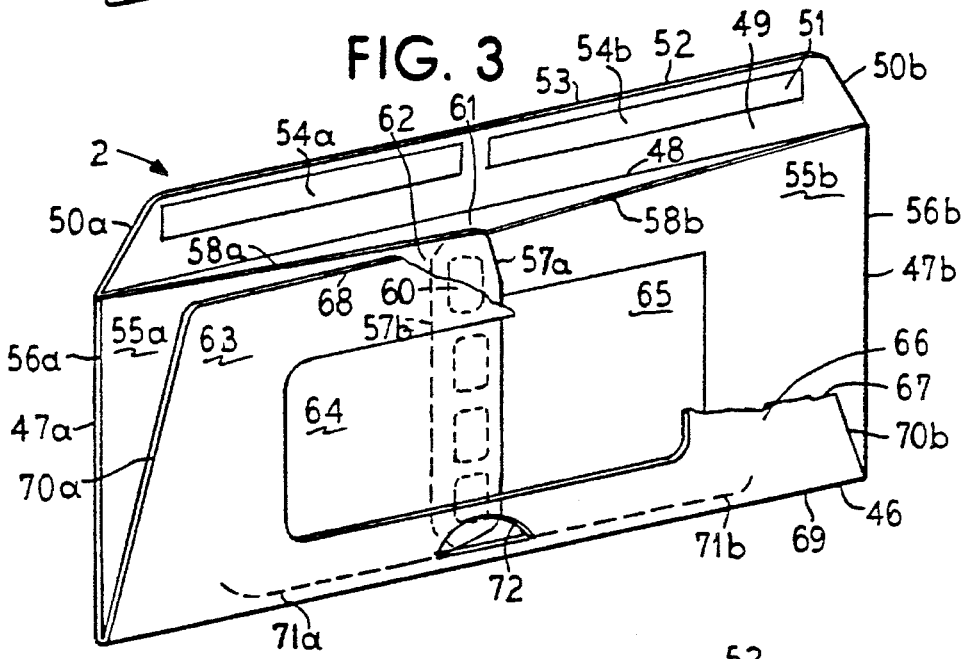
FIG. 3 is a rear perspective view of the envelope with portions broken away to reveal the internal construction thereof.

FIG. 3 illustrates a rear view of the envelope showing the seal flap 49 in an upright and uncreased position. The seal flap 49 includes side edges 50*a* and 50*b* and distal outer edge 53. An inside face 51 and outside face 52 are included wherein the inside flap includes re-moistenable glue spots 54*a* and 54*b* on the inside face 51 near the distal edge 53 of the seal flap 49.

Figures 5, 6, 7:
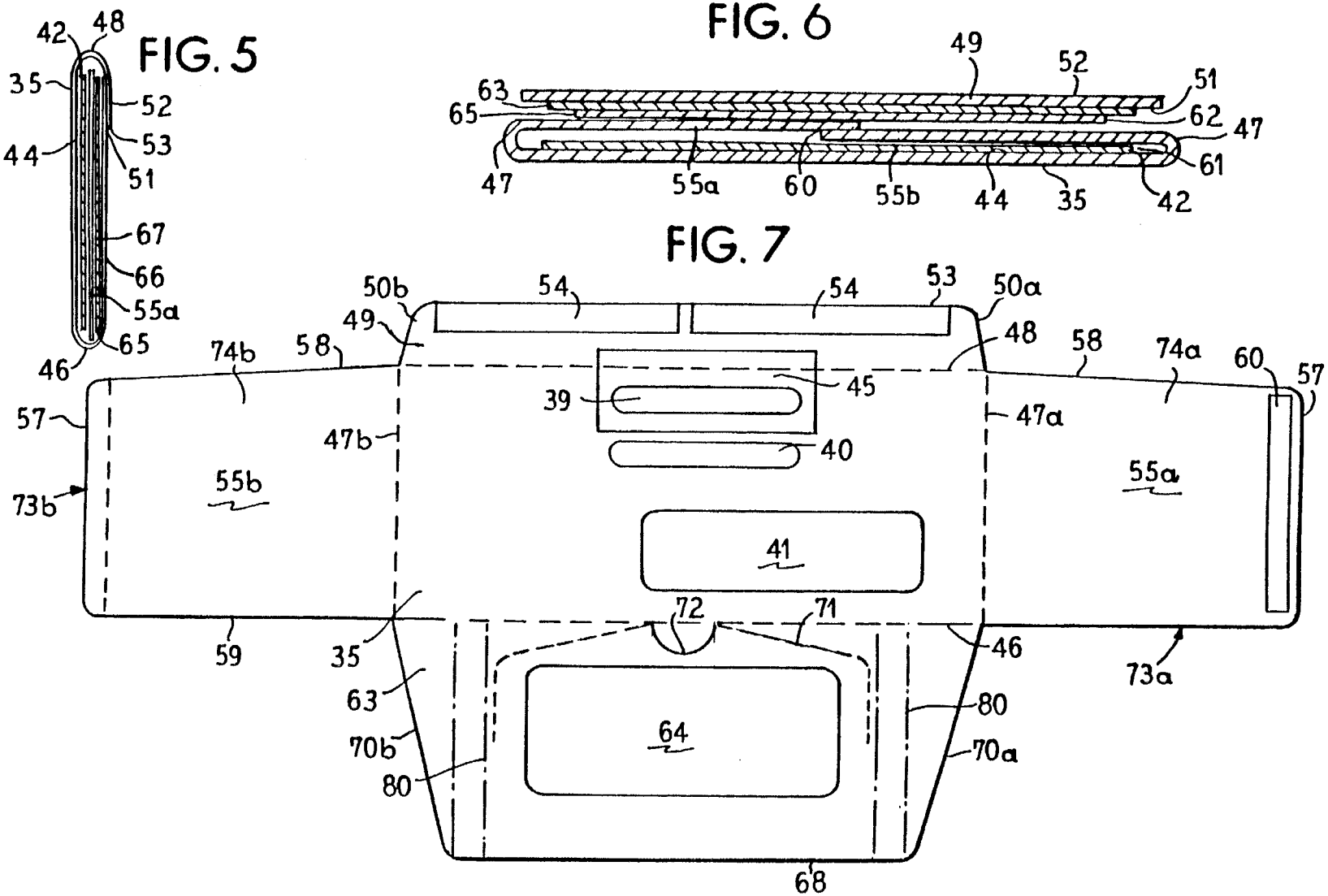
FIG. 5 is a cross-sectional view of the envelope taken generally along line 5—5 in FIG. 2.
FIG. 6 is a cross-sectional view of the envelope taken generally along line 6—6 in FIG. 2.
FIG. 7 is a plan view of a blank for forming the envelope.

The envelope 2 further includes side flaps 55*a* and 55*b* located proximate side edges 56*a* and 56*b*. The proximate side edges 56*a* and 56*b* are separated from the front panel 35 of envelope 2 by fold lines, or welded seams, 47*a* and 47*b*, respectively. The distal edges 57*a* and 57*b* of side flaps 55*a* and 55*b* cross at a point near the center of the back panel 63 of the envelope 2. The side flaps 55*a* and 55*b* further include top edges 58*a* and 58*b* and bottom edges 59*a* and 59*b* (as shown in FIG. 7). An adhesive 60 secures the side flaps 55*a* and 55*b* to each other by overlapping each side flap 55*a* and 55*b* near distal side edges 57*a* and 57*b*. Each side flap also includes inner faces 73*a* and 73*b* and outer faces 74*a* and 74*b* (as shown in FIG. 7).

A main compartment 61 of envelope 2 is further shown in FIG. 3. A back compartment 62 as part of the back panel 63 of envelope 2 is also shown. A window area 64 on the back panel 63 of envelope 2 is made of a transparent material 65 which is adhesively attached to an inside face 67 of the back panel 63. The transparent material 65 is positioned such that a sender's return address will show through the back panel 63. The back panel 63 includes an outer face 66, an inside face 67, an upper edge 68, a lower edge 69 which is separated from the front panel 35 of envelope 2 by the fold line, or welded seam 46.

Side edges 70*a* and 70*b* are secured to side flaps 55*a* and 55*b* with strips of adhesive 80 (shown in FIG. 7) on the inside face 67 of the back panel 63. Tear lines 71*a* and 71*b* near the lower edge 69 of the back panel 63 allow for access to the back compartment 62 of the envelope 2. A thumb notch 72 is centrally located between the tear lines 71*a* and 71*b* for grasping the back panel 63 to open along the tear lines 71*a* and 71*b*.

Figure 4:
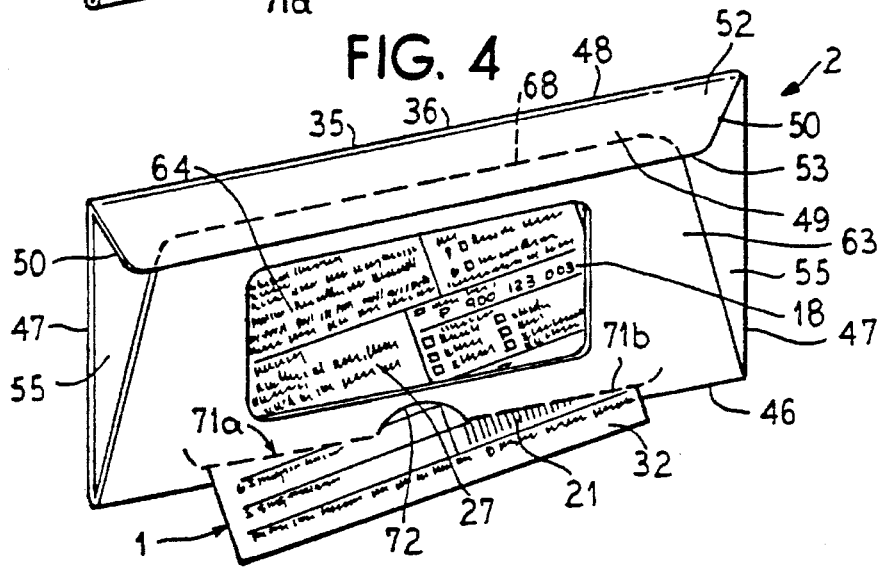
FIG. 4 is a rear perspective view of the envelope showing a portion of the back panel being opened along tear lines for removal of the contents of the back compartment of the envelope.

FIG. 4 shows the sheet form 1 as it would be pulled from the envelope 2 through the tear lines 71*a* and 71*b*. The form 1 is partially exposed at the thumb notch 72 such that an individual may pull the form 1 through the bottom of the envelope 2 at the tear lines 71*a* and 71*b*. Further illustrated in FIG. 4, the envelope 2 is shown with the seal flap 49 creased such that the outside face 52 of the flap 49 encloses the main compartment 61 and back compartment 62 (shown in FIG. 3). The form 1 shown in FIG. 4 is within the back compartment 62 such that the tear lines 71*a* and 71*b* open the back compartment 62 of the envelope 2.

FIG. 5 shows a cross-sectional view of the envelope 2 taken along line 5—5 in FIG. 2. The front panel 35, the outside face 52 of the seal flap 49, the seal fold flap line 48 and the lower fold line 46 separating the front panel 35 from the back panel 63 having an outer face 66 form the extremities of the cross-sectional view of the envelope 2. The transparent material 42 generally covers windows and is adhesively attached to the inner surface 44 of the front panel 35 of the envelope 2.

FIG. 6 illustrates a cross-sectional view of the envelope 2 taken generally along line 6—6 in FIG. 2. From this view, it is clear the transparent materials 42 and 65 are adhesively attached to respective inside faces 44 and 67. The generally open area forming the main compartment 61 is shown being surrounded by the transparent material 42 and the side flaps 55*a* and 55*b*. The back compartment 62 is generally shown by the open area enclosed by the transparent material 65 covering the inside face 67 of the back panel 63 and the side flaps 55*a* and 55*b*.

FIG. 7 illustrates a blank for forming the envelope 2. The envelope 2 as shown is a single layer with all of the fold lines uncreased. The envelope 2 may be formed by folding the side flap 55*a* at side flap fold line 47*a* and folding side flap 55*b* at side flap fold line 47*b*. Furthermore, the back panel 63 is folded and creased at the lower fold line 46, and the seal flap 49 is folded and creased at the seal flap fold line 48. The resulting envelope 2 with the upper window 39, the middle window 40 and the lower address window 41 results on the front panel 35. The window area 64 on the back panel 63 results from the folding of the back panel 63 at the crease line 46.

Figure 8:
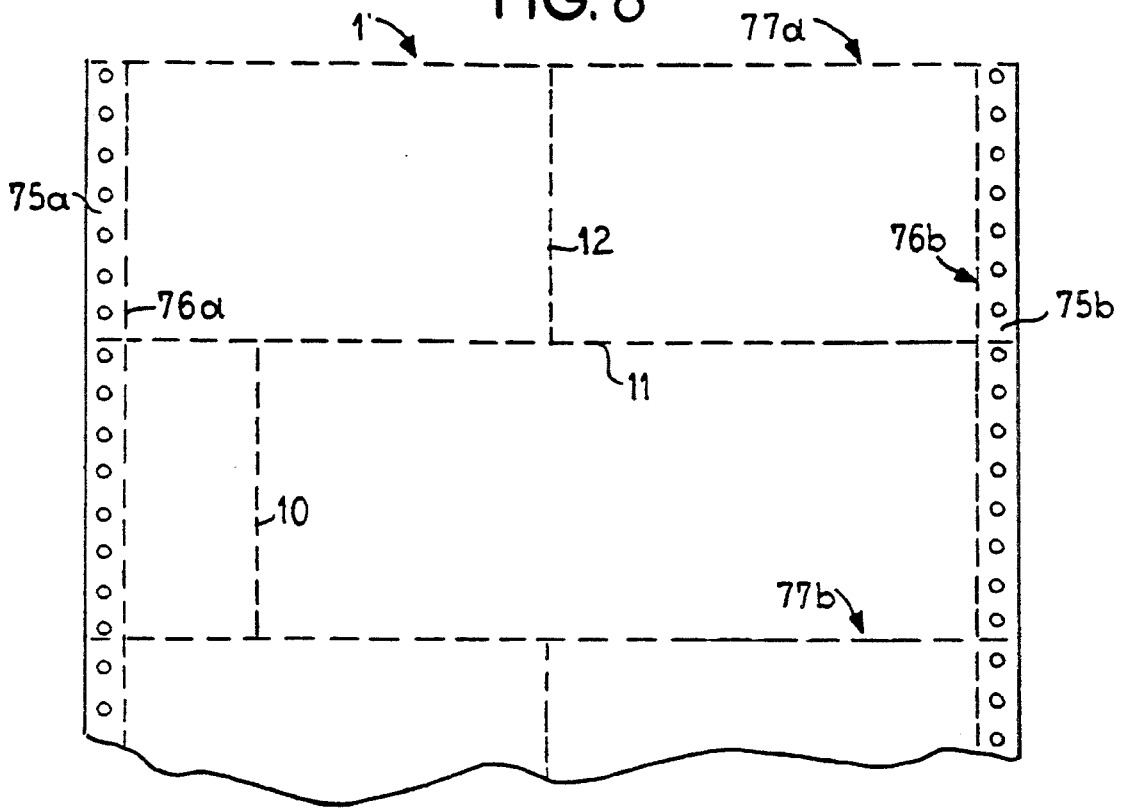
FIG. 8 is a front elevational view of a form comprising a modified embodiment of the form portion of the present invention, such modification to enable continuous feeding of the form through printers equipped for feeding.

FIG. 8 shows a form with side tab areas 75*a* and 75*b* such that punched holes in the tab areas 75*a* and 75*b* may be engaged to a printing mechanism (not shown), such as pin or sprocket-fed printers, for continuous feeding and printing of the form 1 through the printer. The form 1 may be pre-manufactured to include the tear lines 10, 11 and 12. In addition, tear lines 76*a* and 76*b* removes the tab areas 75*a* and 75b from the form 1. Finally, tear lines 77a and 77b are included between each form 1 such that each form 1 may be separated from each other after being printed. As a result, the forms 1 may be provided in a continuous length and separable from one another by tear lines 77a and 77b.

Figure 9:
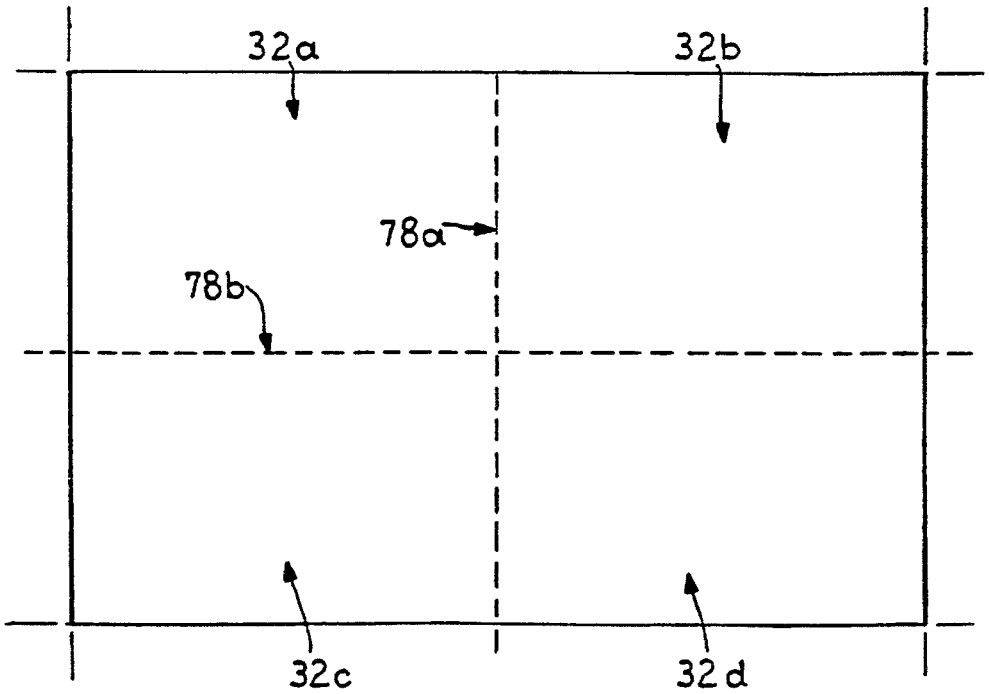
FIG. 9 is a front elevational view of a form comprising a modified embodiment of the form port, ion of the present invention, such modification to enable printing multiple return cards for use with a separately-produced insert.
Figure 10:
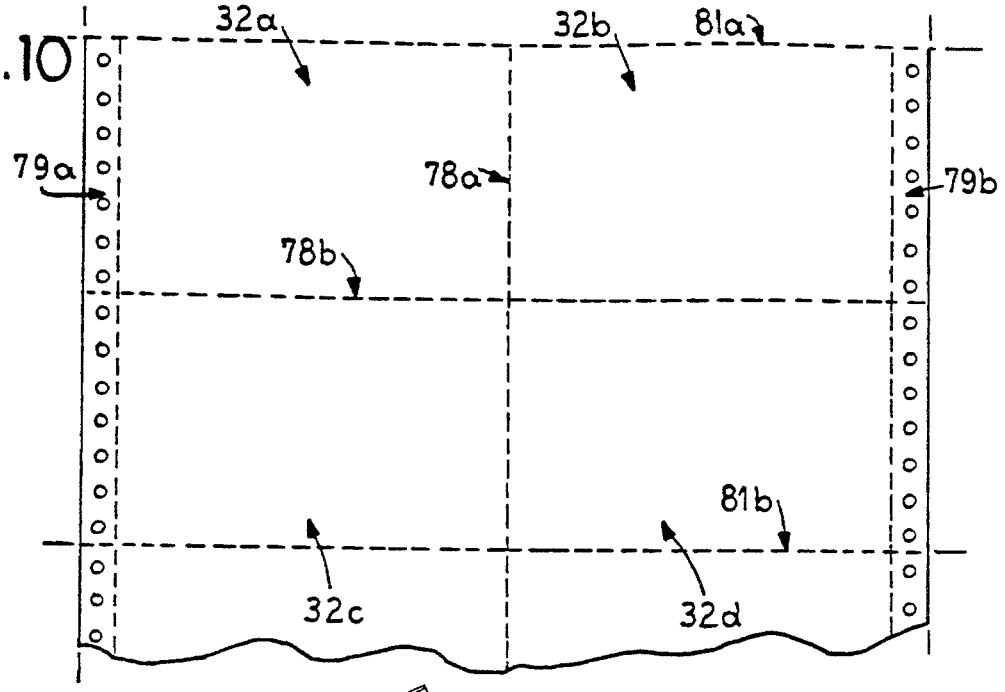
FIG. 10 is a front elevational view of an additional modification for continuous feeding of the form portion shown in FIG. 9.

FIGS. 9 and 10 illustrate modified embodiments for printing multiple reply card parts 32. As shown in FIG. 9, multiple reply pans 32a, 32b, 32c and 32d include tear lines 78a and 78b arranged to form four equal sections on a single sheet. This allows for multiple return cards 32a, 32b, 32c and 32d to be separately produced from the insert form 1. Since all related parts are connected on a single sheet, they can be printed or addressed in a single pass through a printer equipped to feed single, unconnected cut sheets.

Like the form shown in FIG. 8, FIG. 10 illustrates how the multiple reply parts 32a, 32b, 32c and 32d may be continuously printed on a printer (not shown) equipped for continuously feeding through holes punched in the tab areas 79a and 79b. Additional tear lines 81a and 81b are included in addition to the tear lines shown in FIG. 9 for separating groups of reply card parts 32a, 32b, 32c and 32d from each other. As is shown in FIG. 10, reply card parts 32a and 32b may be separated from reply card parts 32c and 32d or the cards may be printed for an extended period before any of the reply card parts 32a, 32b, 32c and 32d are separated from each other.

Figure 11:
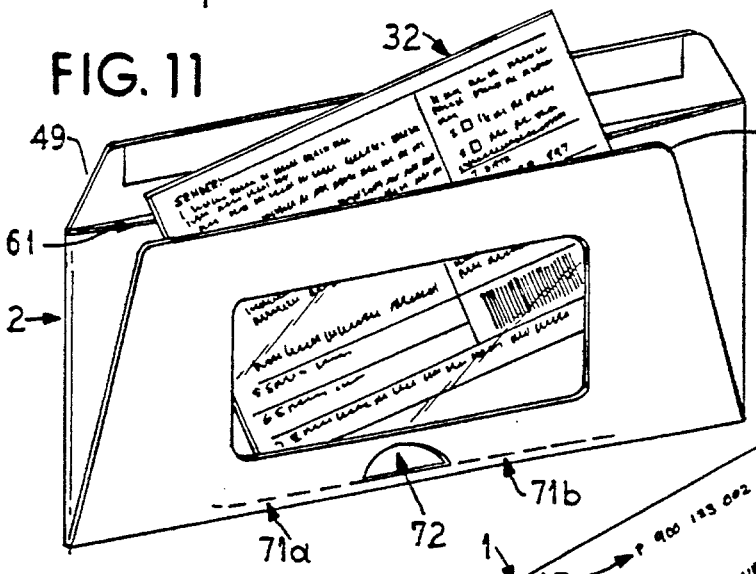
FIG. 11 is a rear perspective view of the mailer portions illustrated in FIGS. 1 and 2, as assembled for use but before sealing, with portions broken away to show the inserted part of the form portion of the invention in its position relative to the envelope portion of the present invention.
Figure 12:
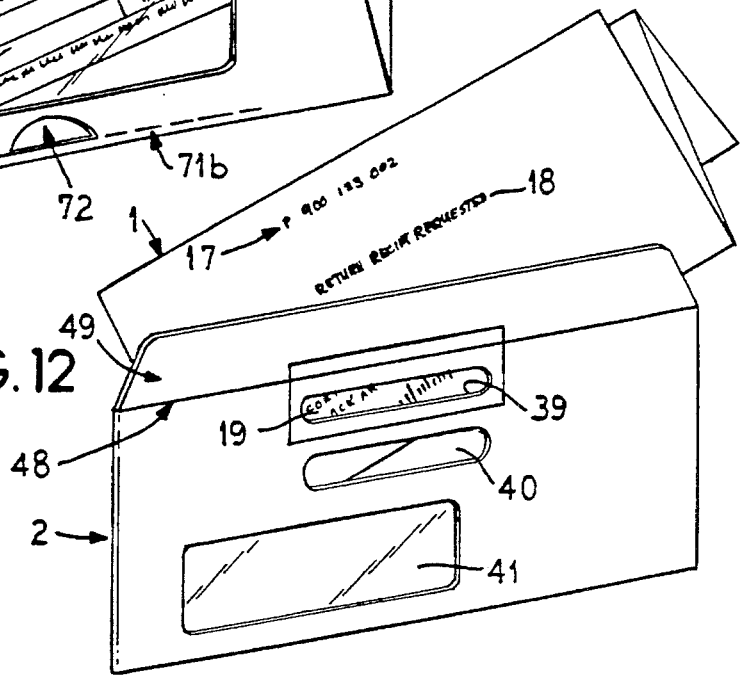
FIG. 12 is a front perspective view of the mailer portions illustrated in FIGS. 2 and 9 as assembled for use but before sealing, with portions broken away to show the inserted part of the modified form portion of the invention in its position relative to a separately-produced insert, both in position relative to the envelope portion of the present invention.

FIGS. 11 and 12 show the envelope 2 with the inserted parts of the form 1 in their positions before the envelope 2 is sealed. In FIG. 11, the reply card part 32 is being inserted into the back compartment 62 of envelope 2. The seal flap 49 is in an uncreased position so as to accept the reply card insert part 32 into the back compartment 62 and to receive the form 1 into the main compartment 61.

FIG. 12 illustrates the form 1 being inserted into the envelope 2 such that the identifying number areas 17, 18 and 19 may be read through the upper window 39, the middle window 40 and the lower window 41, respectively. After all of the requisite material is inserted to the main compartment 61 and the back compartment 62, the envelope 2 may be sealed by creasing the seal flap 49 at the seal flap fold line 48.

As a result of the above-described form 1 and envelope 2, a single-layer multi-mailer assembly is formed with all related parts of the form 1 being printed on a single layer of material. The related parts of the form 1 may be addressed or otherwise overprinted using impact-type printers or non-impact-type printers or non-adjustable impact printers. Additionally, all of the related parts of the form 1 may be addressed or printed in original resulting in improved legibility, including the improved legibility of high-resolution barcodes which may be printed on all parts of the form 1 for later automatic identification.

As a result, information and functions are capable of being performed using the high-resolution barcodes printed on the form 1. Address information from other computer data base files may be automatically imported rather than re-typing the address data which already exists in a compatible format. Furthermore, entry and reportings of postage in decimal fractions of cents is facilitated resulting in automation compatability and pre-sort postage discounts being available.

The barcode printed on the receipt may also be scanned to allow for automated entry of return receipt information printed on the receipt instead of requiring an operator to key a ten-digit number. In addition, certified mail forms with the high-resolution barcodes may be automatically matched with the postal article number to allow for printing of form letters related to the matched article number and certified mail form. The return address of the sender may also be automatically printed on the back of the return receipt card by any suitable printer based on choices entered by a user. Therefore, no additional parts or forms are required to be glued, adhered, taped or otherwise attached to the outside of the envelope 2. The reply part card 32, however, may be easily removed upon delivery to the addressee without exposing or disturbing the remainder of the contents of the envelope 2.

Figure 13:
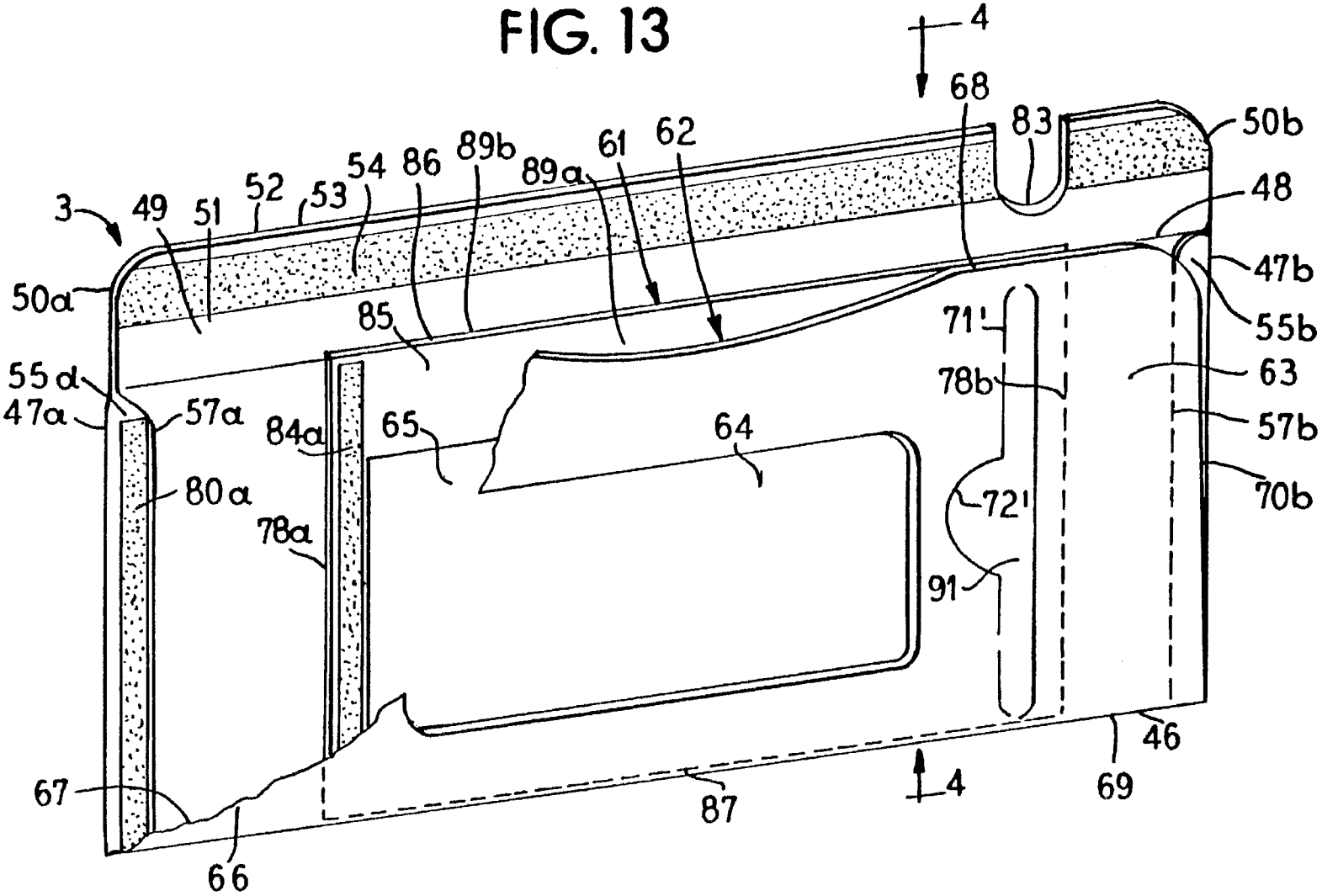
FIG. 13 is a front perspective view of another embodiment of the envelope portion of the invention with portions broken away to show the use of a separate patch adhesively attached inside the back panel of the envelope as an alternative means of forming the back compartment.

A modified embodiment of the present invention is shown in FIGS. 13–17. The envelope 3 shown in FIG. 13 is similar to the envelope shown in FIG. 3 wherein like numerals designate like parts. The envelope 3 in FIG. 13 includes a notch 83 in the seal flap 49 in alignment with the extreme upper end of a pull tab 91 on the back panel 63. This allows for the opening of the back compartment 62. Adhesive areas 84a and 84b secure an inside patch 85 to an inside face 67 of the back panel 63. The inside patch 85 is adhered to the adhesive areas 84a and 84b to form the back compartment 62 in alignment with the back window 64.

Upper edge 86 of the inside patch 85 is left unattached to form the top opening of the back compartment 62 to enable the insertion of the reply card 32. Lower edge 87 of the inside patch 85 rests against the lower fold 46 inside the envelope 3. Side edges 78a and 78b of the inside patch 85 have the adhesive areas 84a and 84b located adjacent thereto to secure the patch 85 to the inside of the envelope 3. The patch 85 has an outside face 89a facing toward the back compartment 62 of the envelope 3, and an inside face 79b facing toward the front compartment of the envelope 3. The pull tab 91 on the back panel 63 is secured by perforations at the tear lines 71'. The tab 91 is removed by gripping at the thumb notch 72'.

Figure 14:
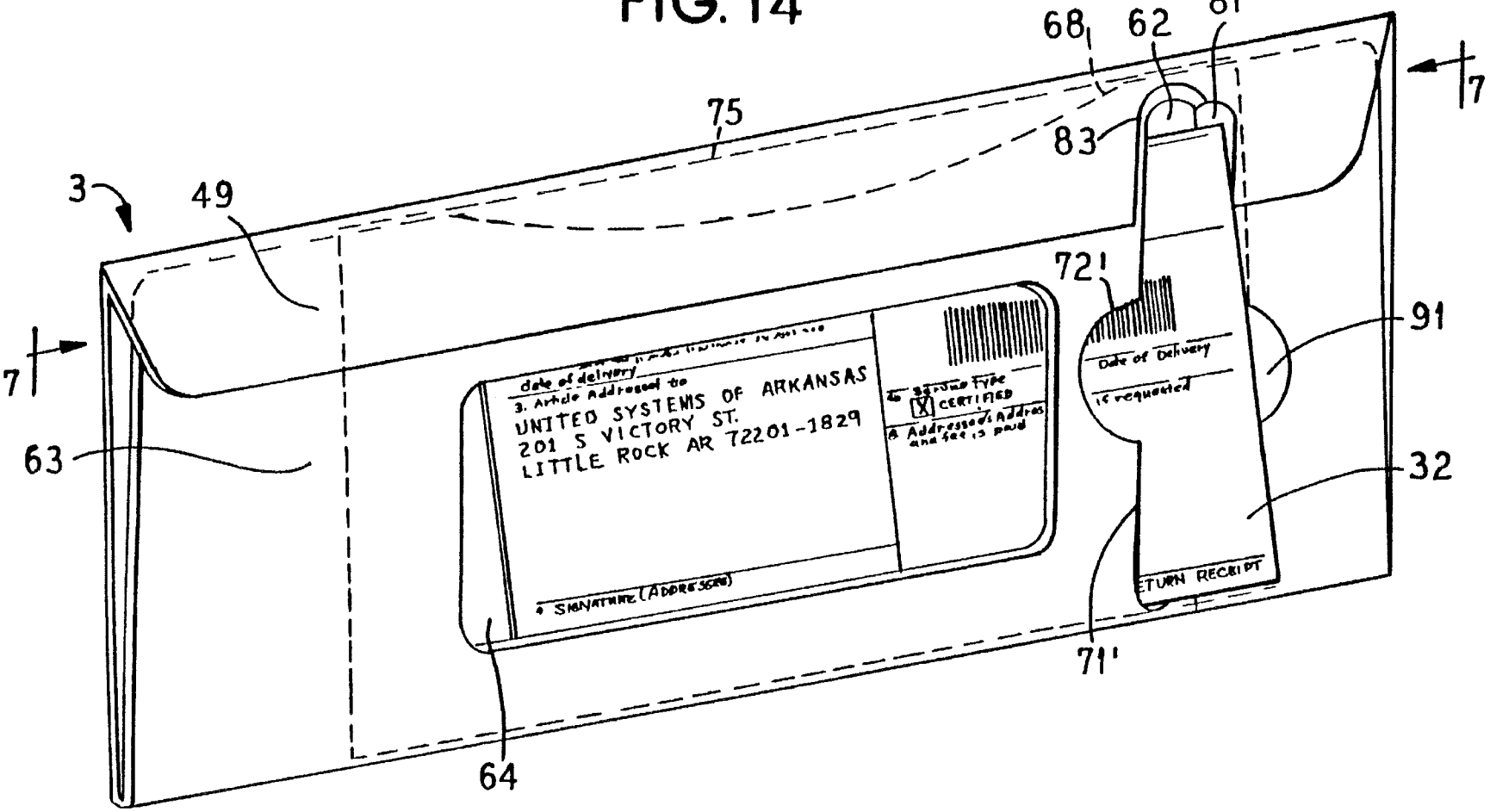
FIG. 14 is a rear perspective view of the envelope shown in FIG. 13 as assembled and sealed for use with the form portion inserted.
Figure 15:
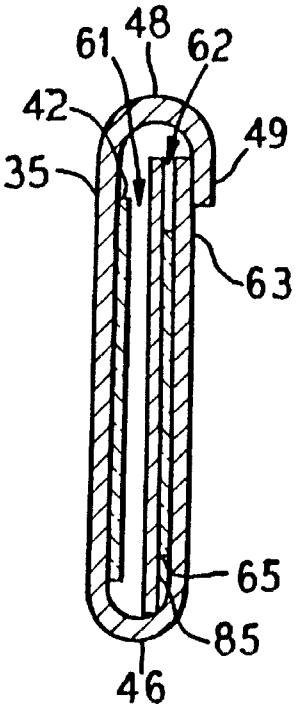
FIG. 15 is a cross-sectional view of the envelope taken generally along line 4—4 in FIG. 13.
Figure 16:
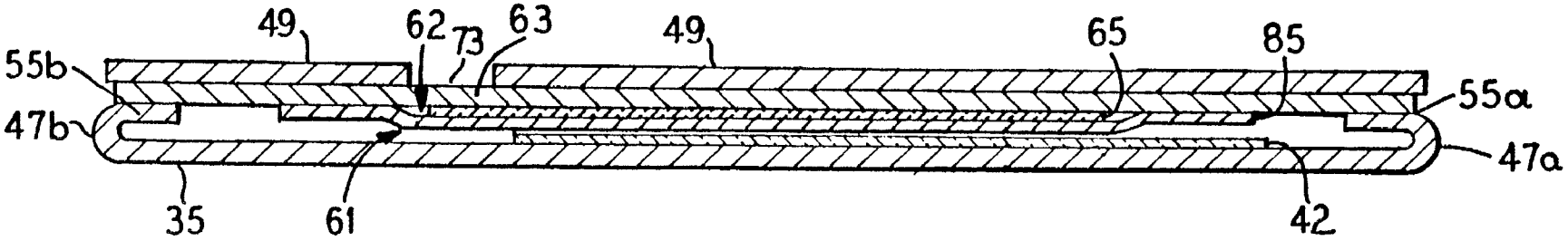
FIG. 16 is a cross-sectional view of the envelope taken generally along line 7—7 in FIG. 14.

FIG. 14 illustrates the reply card 32 partially removed through the opening created by pulling the tab 91 along the vertical tear lines 71'. The notch 84 in the seal flap 49 aligns with the upper end of the pull tab 91 on the back panel 63 when the envelope 3 is sealed. FIGS. 15 and 16 show cross-sectional views taken along line 4—4 in FIG. 13 and along line 7—7 in FIG. 14, respectively. The separate inside patch 85 is clearly shown in FIGS. 15 and 16.

Figure 17:
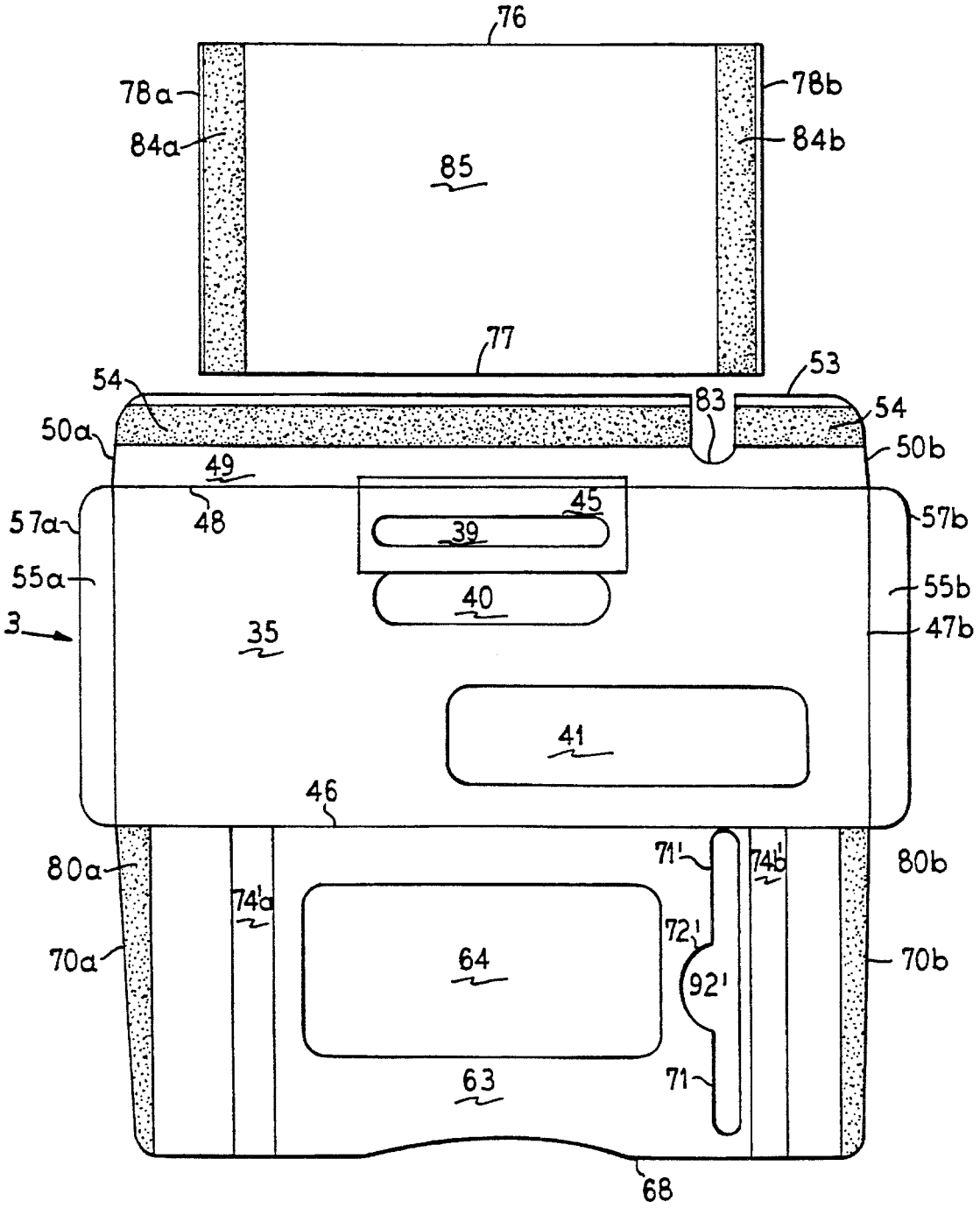
FIG. 17 is a plan view of blanks for forming the envelope of FIG. 13.

In FIG. 17, the separate patch 85 is shown in blank form to be attached to the inside of the envelope 3 to form the back compartment 62. The adhesive areas 84a and 84b of the patch 85 are adhesively secured to form the back compartment 62 on the back panel 63 at the areas 84a' and 84b'.

Although other modifications and changes may be suggested by those skilled in the art, it is the intention of the inventor to embody within the patent warranted hereon all changes and modifications as reasonably and properly come within the scope of the contribution to the art.

I claim:

1. A method for forming a multi-part mailing assembly for mailing an article requiring a special service, said method comprising the steps of:

providing a single-layer form having a plurality of detachable parts;

printing information on said form related to the special service required for the article;

separating each of said plurality of detachable parts along lines of separation to form individual discrete parts;

providing an envelope separated from the form having a plurality of compartments; and inserting the individual discrete parts into each of the plurality of compartments to expose a portion of each of the discrete parts through at least one window integrally formed in each of said plurality of compartments.

2. The method of claim 1 wherein said printing step prints information on said form in a single pass.

3. The method of claim 1 wherein said form may be continuously printed resulting in a plurality of forms having a plurality of detachable parts, said plurality of forms being separable from each other.

4. The method of claim 1 wherein one of said detachable parts may be continuously printed.

5. The method of claim 1 wherein one of said detachable parts may be multiply printed on a single sheet in a single pass.

6. A method for forming a multi-part mailer assembly for mailing an article requiring a special service, the method comprising the steps of:

providing a form having printed information relating to the special service required for mailing the article, the form being a single layer of material having a plurality of detachable parts wherein the plurality of detachable parts are separable from each other;

separating the plurality of detachable parts by formation of pre-set boundaries on the form wherein the separation of the form into the plurality of detachable parts is along the pre-set boundaries; and providing an envelope separated from the form having an interior capable of receiving at least one of the plurality of the detachable parts and an external means capable of accessing at least one of the plurality of the detachable parts in the interior of the envelope.

7. The method of claim 6 further comprising the step of:

dividing the interior into a plurality of compartments wherein a first compartment secures and exposes appropriate portions of the information from the form in addition to other inserted materials and further wherein a second compartment is separate from the first compartment so as to avoid disturbing the remainder of the plurality of detachable parts and the other inserted materials in the first compartment.

* * * * *